United States Patent [19]

Kraft

[11] Patent Number: 4,679,266

[45] Date of Patent: Jul. 14, 1987

[54] VARYING FIRMNESS MATTRESS

[76] Inventor: Eugene Kraft, 2760 W. Warren Ave., Detroit, Mich. 48208

[21] Appl. No.: 830,091

[22] Filed: Feb. 18, 1986

[51] Int. Cl.[4] ..... A47C 27/00

[52] U.S. Cl. ..... 5/464; 5/474

[58] Field of Search ..... 5/446, 447, 464, 474

[56] References Cited

U.S. PATENT DOCUMENTS

| | | | |
|---|---|---|---|
| 3,551,924 | 1/1971 | Frye, Sr. | 5/447 |
| 3,828,378 | 8/1974 | Flam | 5/464 |
| 3,885,258 | 5/1975 | Regan | 5/464 |
| 3,999,234 | 12/1976 | Regan | 5/464 |
| 4,042,987 | 8/1977 | Rogers | 5/464 |
| 4,053,957 | 10/1977 | Regan | 5/464 |
| 4,161,045 | 7/1979 | Regan | 5/447 |
| 4,161,046 | 7/1979 | Golembeck | 5/464 |
| 4,222,137 | 9/1980 | Usami | 5/446 |

*Primary Examiner*—Gary L. Smith
*Assistant Examiner*—Michael F. Trettel
*Attorney, Agent, or Firm*—Cullen, Sloman, Cantor, Grauer, Scott and Rutherford

[57] ABSTRACT

A standard size mattress is formed with four longitudinally arranged regions, i.e., a head, an upper torso, a lower torso and a leg support region, for supporting a person comfortably and substantially level. The length of the head support region is equal to the approximate height of a person's head and neck. The length of the combined torso support regions is equal to the approximate height of a person's torso from the crotch to the juncture with the neck, with the upper torso region being roughly two-thirds and the lower torso region being roughly one-third of the length of the combined torso support regions. The length of the leg portion is equal to approximately the height of the legs from the crotch to the bottom of the feet. Thus, the lengths of the four regions are roughly in the ranges of 18%, 23%, 14% and 45%, respectively, of the length of a typical standard mattress. Each of the head, leg support and the two torso regions are of a single, constant support firmness, which differ from their adjacent regions. The upper torso region is the most firm, the head and lower torso regions are of about the same mid-firmness, and the leg support region is least firm. The lengths of the torso and leg regions vary for different length standard mattresses while the head region remains approximately the same length for different length mattresses.

7 Claims, 2 Drawing Figures

VARYING FIRMNESS MATTRESS

BACKGROUND OF INVENTION

Conventional mattresses and box springs or foundations are of uniform firmness along their entire lengths and widths. A conventional mattress, whether of the coil spring construction or water-bed or foam or air constructions, is so soft that the upper torso of the person resting upon it tends to sag down relative to the legs. Thus, the legs are ordinarily elevated slightly relative to the lower part of the torso. This results in the lower part of the torso not being properly supported when the individual is lying in a straight line either on his back or side.

As is well known, individuals vary considerably in size, weight and proportions. However, commercially available mattresses which are made in mass production, are typically made in certain predetermined, standard sizes, such as in 75 inch, 80 inch, or 84 inch lengths and the like. Since a mattress cannot be economically made to individually fit each person who rests upon it, the mattress industry has produced mattresses which are of, pre-selected standard uniform firmnesses. That is, a particular mattress may be of a soft or a hard or a medium firmness. Hence, the individuals resting upon a mattress do not get the optimum or, in many cases, even a reasonably comfortable support for their backs, that is, the lumbar regions and adjacent portions of the body. Frequently, the lumbar region is not in full contact with the mattress so that it is not supported.

Mattresses have been made with a denser, or firmer central one-third, as compared with the upper and lower thirds, taken along their length directions. This provided a symetrical construction, wherein the upper and lower third were of the same density to provide the same support firmness, and the central one-third had a greater firmness. But this has not given adequate back support because of the wide variation in anatomy of people. Thus, it has not bee thought to be commercially feasible to adequately vary the firmness of support given by a single mattress. The invention herein relates to producing a single mattress having regions of different firmnesses proportional to the average linear weight distribution. Such assymetrical construction provides a reasonably comfortable and level support for the maximum number of people, notwithstanding some variations in their sizes and weights.

SUMMARY OF INVENTION

The invention herein relates to a mattress, such as a conventionally constructed coil spring mattress, or a water-bed, or air or foam type mattress or box spring, which is divided along its length into four major regions, of different firmnesses. The uppermost or head region corresponds in length to roughly the height of an average individual's neck and head. The middle or combined torso region corresponds in length to roughly the height of the average individual's torso between the juncture of the neck to the shoulders to the crotch, and is divided into an upper two-thirds torso region and a lower one-third torso region. The lowermost or leg region corresponds in length to the height of the average person's feet and legs up to approximately the crotch.

Each of the regions or zones is of a uniform firmness. However, the adjacent firmnesses differ from each other. The upper torso region is the most firm, the head region is of mid-firmness and the leg region is least firm. The lower torso region is about as firm as the head region. By relating the lengths and firmnesses of each region roughly to the approximate average heights and weights of the corresponding portions of the human body, a mattress, or a box spring, is provided which is a substantial improvement in support comfort and in providing level support for the user. Thus, even though the mattresses are mass produced to standard lengths and widths, and even though the individual users may vary in size and weight and the matresses may support both males and females, whose bodies generally are substantially different in weight and proportions, the overall results produced by the relationships of the four support regions are a substantial improvement for most people.

In providing mattresses of different standard lengths, such as a standard 75 inch mattress or a standrd 80 inch mattress, it is contemplated that the head support regions will be about the same length on all such mattresses, but the torso regions and the leg regions will be varied in length for different length mattresses. This simplifies the mass production of mattress, while producing the improved effect.

In this construction, the transitions between the regions of a mattress are at points that correspond to where the average individual's body transitions occur. That is, the mattress region transitions are located at the places where major weight and size changes occur in the average individual's body. These are at the junction between the neck and shoulders, at about the waist, and at the connection of the legs to the torso, i.e., at about the crotch. As mentioned, the head region may be of a generally fixed length since there are little variations in the weights and heights of most adult human heads and necks. Thus, the mattress is constructed with its several regions roughly matching the lengths between the natural transition points of the average body and with the firmnesses of the mattress regions roughly matching the weights of average body portions between the natural transition points. This provides economically feasible, commercially producable, standard mattresses which are able to give reasonably comfortable and level support to a wide range of individuals lying either on their backs or sides.

One of the objects of the present invention is to produce a varying firmness mattress which can be manufactured with approximately the same ease as a standard, uniform firmness mattress and can be made using conventional mattress construction materials and manufacturing techniques. Thus, the invention permits the use of uniform size and shape springs in each of the three body support regions. Changes in firmness from one region to another can be accomplished, for example, by varying the wire gauge of the springs in the different sections or by varying the barrel of the springs. This permits use of conventional assembly equipment and production steps, by making sub-assemblies of different gauge springs for each region or zone and then joining the sub-assemblies end-to-end.

Another object is to provide a mattress with the lower torso support area softer than the upper torso support area so that the lower torso gets well into the mattress to permit good mattress support for the lower back regions of the upper torso.

These and other objects and advantages will become apparent upon reading the following description of which the attached drawings form a part.

DETAILED DESCRIPTION

Figure 1:
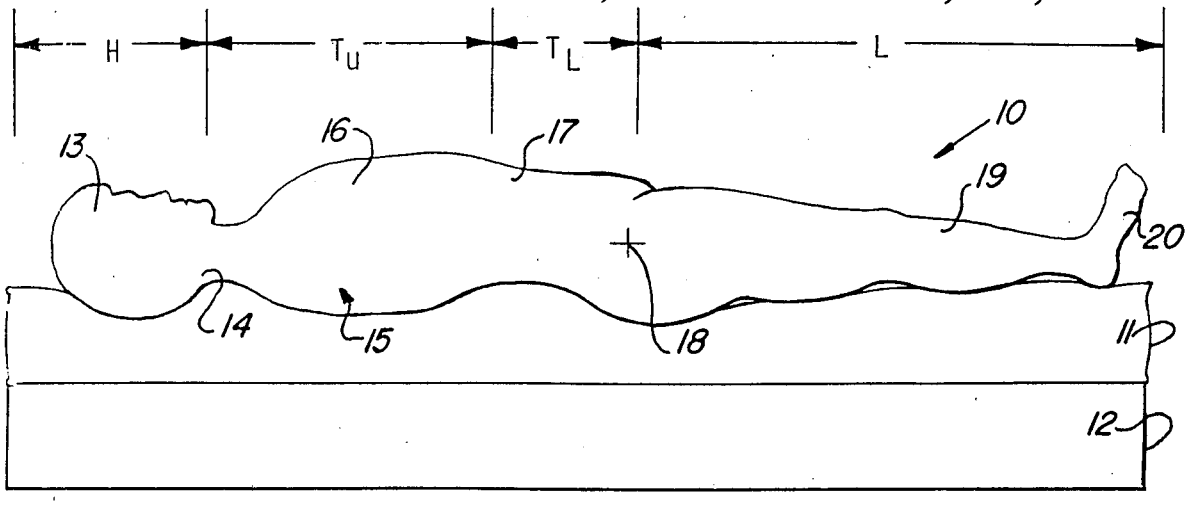
FIG. 1 is a schematic, elevational view of a human figure resting upon a mattress.

FIG. 1 schematically shows a human figure 10 resting upon a mattress 11 which is supported upon a box spring 12. The human figure includes a head 13 and a neck 14 joined to a torso 15. The torso comprises an upper torso 16 and a lower torso 17. At the crotch area, i.e., below the joint 18 between the femur or thigh bone and pelvis, there is a natural transition point at the connection between the torso and the legs 19. The feet 20 are schematically shown at the foot or lower end of the mattress.

An object of this invention is to support the person using a mattress in a substantially level position with a good support for the lower back. Ideally, the mattress should yield a varying amount at each place on the mattress in response to the varying weight of the different parts of the human body resting upon it. That is, ideally, every square inch of the mattress should be made with the appropriate firmness or springiness to correspond to the precise portion of the human body resting upon it. Obviously, that is not feasible, not only because of the commercial need for mass production of mattresses of standard sizes and firmnesses, but also because of the varying sizes and weights and proportions of persons using a particular mattress, and because individuals frequently move their positions on the mattresses. Hence, it is not feasible to precisely support the human body upon a mattress at all times or even at any particular time.

The invention herein is concerned with a mattress which is feasible to construct in mass production, and which will provide a reasonable solution to the problem of providing good support despite such wide variances in people, positions, etc.

Anatomical studies of large numbers of people have produced data concerning averages of heights and weights. For example, an average height male is about 5' 10". Comparisons between average male and female weights and heights are useful in understanding the lengths and firmnesses of the regions comtemplated in the present mattress. These are as follows:

| | Distance from top of head to: | | |
|---|---|---|---|
| | Shoulders | Crotch or Leg Juncture | Bottom Of Feet |
| Average Male | 12.9" | 37.8" | 69.9" |
| Average Female | 11.9" | 35.2" | 63.5" |

| Averages of Body Weight for General Population in U.S. | | |
|---|---|---|
| Body Size | Male | Female |
| Large | 227.8 lbs. | 204.7 lbs. |
| Average | 172.8 lbs. | 139.8 lbs. |
| Small | 126.1 lbs. | 105.4 lbs. |

The weights of various major segments of the human body, in terms of averages, can be expressed as a percentage of total body weight as follows:

| Body Segment | Male | Female |
|---|---|---|
| Head and Neck | 6.7% | 6.7% |
| Chest | 30.2% | 26.3% |
| Abdomen | 2.9% | 4.1% |
| Pelvis Region | 22.6% | 25.6% |
| Right Upper Arm | 2.4% | 2.2% |
| Left Upper Arm | 2.4% | 2.2% |
| Right Forearm & Hand | 2.4% | 1.9% |
| Left Forearm & Hand | 2.4% | 1.9% |
| Right Thigh | 8.0% | 9.1% |
| Left Thigh | 8.0% | 9.1% |
| Right Calf & Foot | 6.0% | 5.5% |
| Left Calf & Foot | 6.0% | 5.5% |

Considering the roughly average lengths of the four major body sections, (1) the head section (i.e., head plus neck up to junction with shoulder), (2) the upper torso section (i.e., between shoulders and waist), (3) the lower torso section (between the waist and crotch or juncture with legs), and (4) leg section (i.e., from crotch to the bottom of feet), a mattress can be divided into four main regions as follows: a head, an upper torso, a lower torso and a leg support region. The upper torso region generally includes the chest and abdomen, etc., and the lower torso region comprises the pelvic area, etc.

The linear divisions and weight distribution along the height of an average male is roughly as follows:

| Area | % of Length of Body | Weight Distribution |
|---|---|---|
| Head/neck | 18.7% | 6.7% |
| Upper Torso | 25% | 42.7% (including weight of arms) |
| Lower Torso | 12.5% | 22.6% (excluding weight of arms) |
| Legs/Feet | 43.75% | 28% |

Corresponding linear divisions can be approximated on standard length mattress, as for example, a 75 inch long and an 80 inch long mattress, as follows:

| For a standard 75 inch long mattress: | | |
|---|---|---|
| Region | Approximate Percentage of Length | Length - Inches |
| Head Region | 18.7% | 14 |
| Mid or Torso Region | 37.3% | 38 |
| Upper Torso Zone | 24.0% | 18 |
| Lower Torso Zone | 13.3% | 10 |
| Leg Region | 44.0% | 33 |

| For a standard 80 inch long mattress: | | |
|---|---|---|
| Region | Approximate Percentage of Length | Length - Inches |
| Head Region | 17.5% | 14 |
| Mid or Torso Region | 37.5% | 30 |
| Upper Torso Zone | 22.5% | 18 |
| Lower Torso Zone | 15.0% | 12 |
| Leg Region | 45.0% | 36 |

In constucting a conventional coil spring mattress, using approximations of this data, with springs which generally are about three inches or slightly more in diameter (as for example, roughly 3.125 inches in diameter), it can be seen that the same number of rows of springs, in the lengthwise direction, can be used for the head support region for both length mattresses. However, the toso support regions, which use more rows of springs than the head region, will vary a little in the number of springs in accordance with the varying length of the mattress. The same spring row variance takes place in the case of the foot or leg support region. Examples of a practical number of springs are as follows:

| | | |
|---|---|---|
| For a standard 75 inch long coil spring mattress: | | |
| Head Region | 4 rows | 16.7% of length |
| Torso Region combined | 9 rows | 37.5% of length |
| Upper Torso Zone | (6 rows) | 25% of length |
| Lower Torso Zone | (3 rows) | 12.5% of length |
| Leg Region | 11 rows | 45.8% of length |
| Total | 24 rows | |
| For a standard 80 inch long coil spring mattress: | | |
| Head Region | 4 rows | 15.4% of length |
| Torso Region combined | 10 rows | 38.4% of length |
| Upper Torso Zone | (6 rows) | 25% of length |
| Lower Torso Zone | (4 rows) | 15.4% of length |
| Leg Region | 12 rows | 46.2% of length |
| Total | 26 rows | |

The calculations of approximate percentages of lengths of the springs in each region are based upon the number of rows of springs for the region divided by the total number of rows of springs along the length of the mattress. For this purpose the spring diameters are assumed to be the same size. It can be seen that the percentage of springs in the four regions are close for both the longer and shorter mattress and for the average human body.

Thus, it can be seen that using rough figures, the four regions handle most people. The springs can be made of different firmnesses to accommodate different weights and weight distributions.

Figure 2:
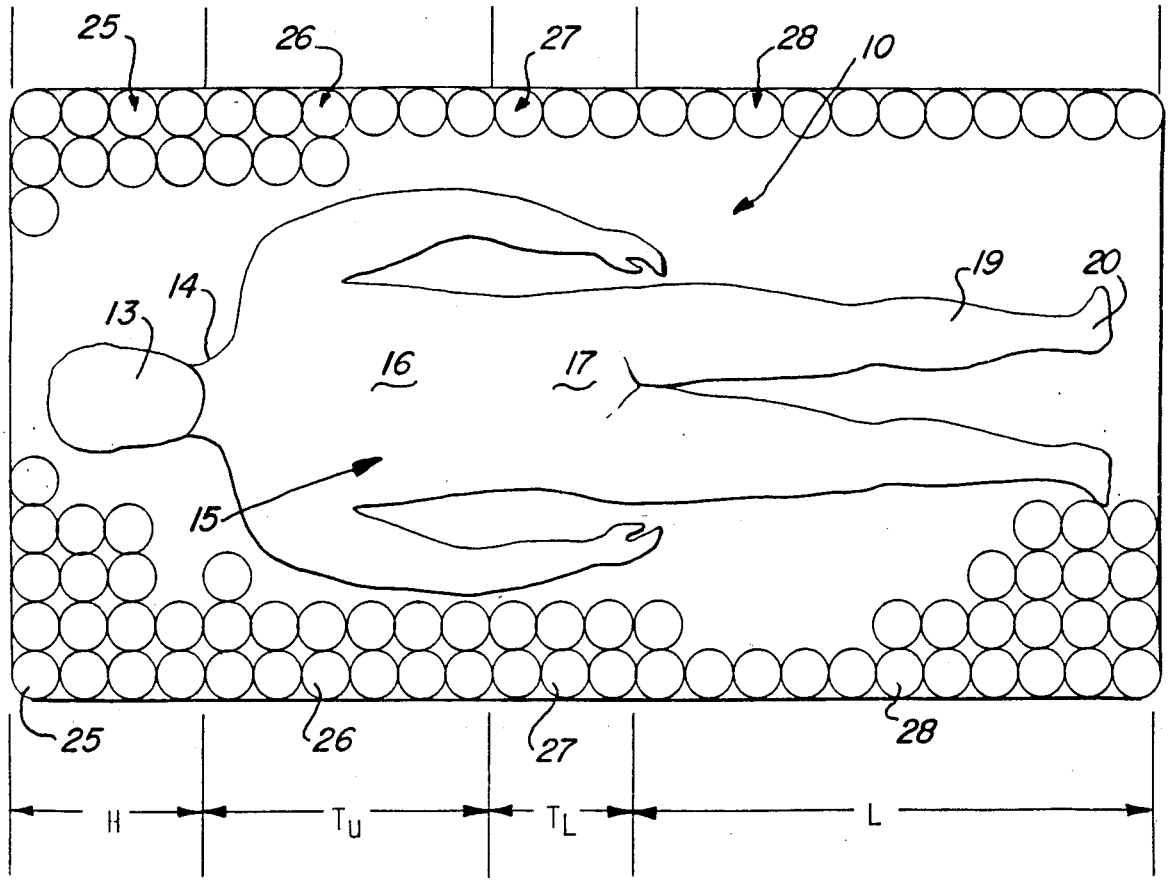
FIG. 2 is a schematic, plan view showing the human figure resting upon the mattress with coil springs schematically shown.

Turning to FIG. 2, the human body, schematically shown as 10, is rested upon a coil spring mattress (schematically shown) formed of numerous rows of coils 25 which make up the head support region H, numerous rows of coil springs 26 and 27 which, respectively, make up the upper torso support region $T_u$ and $T_L$ and rows of coil springs 28 which make up the leg support region L.

The two springs may be of any suitable conventional type. For example, conventional hour glass form or cylindrical form or continuous, integral wire, springs or variations of these may be used. These various types of springs are commercially available and well known. By using springs that are made of thicker or thinner gauges of wire, or more or less resilient wire, or of differing barrels or hour glass sizes, etc., the stiffnesses of the springs can be adjusted. Examples of varying the spring gauge in standard 75 inch and 80 inch length coil spring mattress are:

| Region | Approx. Length | Number of Rows of Coils | Gauge of Coil Wire |
|---|---|---|---|
| Example of 75 inch long coil spring mattress | | | |
| Head | 14" | 4 | 13 |
| Upper torso | 18" | 6 | 12.5 |
| Lower torso | 10" | 3 | 13 |
| Legs/feet | 33" | 11 | 13.5 |
| Example of 80 inch long coil spring mattress | | | |
| Head | 14" | 4 | 13 |
| Upper torso | 18" | 6 | 12.5 |
| Lower torso | 12" | 4 | 13 |
| Legs/feet | 36" | 12 | 13.5 |

The stiffer, heavier gauge, i.e., $12\frac{1}{2}$ gauge, wire in the upper torso region provides a relatively firmer or stiffer body support than the 13 gauge springs of the adjacent head support and lower torso regions. The $13\frac{1}{2}$ gauge springs of leg support region are considerably less firm.

The firmness of the mattress or box spring can also be varied by varying the density of the support. For example, more or less springs can be used to control firmness. In the case of a foam mattress, for example, denser or less dense foam material can be used.

To summarize, a standard length mattress, e.g., 75 inch or extra long 80 inch length, is divided into four regions, namely the head region which comprises roughly 18% of the mattress length, the torso support region comprising roughly 73% of the mattress length and which is subdivided into an upper zone of roughly 25% and a lower zone of roughly 14% and the leg support region comprising roughly 45% of the mattress length. The firmness of the springs in each one of the head and leg regions and the two torso regions is constant. But firmness varies in an assymetrical fashion along the length of the bed. The width of the bed can vary either as a single bed, a queen size or king size, etc. by varying the number of springs in each row. For example, a double width bed may have 14 springs in a transverse row, and queen and king size widths may have 15 and 19 springs, respectively. The firmness is uniform from side to side at any particular location on the mattress. However, in some mattresses the springs along the outer edges may be of a stiffer gauge (e.g., $12\frac{1}{2}$ gauge) to form a stiff border to maintain the shape of the mattress.

The same sort of firmness variations can be applied to a box spring used to support a mattress or with other types of matresses such as a water, air or foam mattress, etc.

Thus, the term mattress as used herein also encompasses foundations, such as box springs.

By way of examples of 75 inch and 80 inch long spring box springs, using larger diameter springs:

| Region | Number of Rows Of Coils | Gauge of Coils |
|---|---|---|
| For a standard 75 inch long box spring: | | |
| Head | 2 | 10 |
| Upper torso | 2 | 9.5 |
| Lower torso | 1 | 10 |
| Legs/feet | 4 | 10.5 |
| For a standard 80 inch long box spring: | | |
| Head | 2 | 10 |
| Upper torso | 2 | 9.5 |
| Lower torso | 1 | 10 |
| Legs/feet | 5 | 10.5 |

Although, not precise, the firmness variances described above will accommodate a substantial portion of the population in the United States and provide a substantial improvement in comfort, better support of the lumbar region of the body, and level support of the body.

Having fully described an operative embodiment of this invention, I now claim:

1. A standard type mattress formed with varying firmnesses for supporting a predetermined, generally average height and weight person comfortably and substantial level, comprising:

the mattress being divided into four major body support regions along its length, namely, a head support region, an upper torso support region, a lower torso support region and a leg support region;

the head support region extends from the mattress upper end towards the lower end a distance equal to roughly the height of an average head and neck beginning about at the juncture of the neck to the shoulders to the top of the head;

the upper torso support region extends a distance roughly equal to the average distance between about the neck and shoulder juncture to the waist, and the lower torso support region extends a distance roughly equal to the average distance between about the waist to the crotch so that the upper torso region is roughly two-thirds and the lower torso region is roughly one-third the length of an average person's torso;

and the leg support region extends from the lower torso support region to the lower end of the mattress a distance roughly equal to between about the height of the legs of an average person from the crotch to the bottom of feet;

and with each of the head and leg support regions and the upper and lower torso regions being constructed so that it has its own uniform springy firmness, with the upper torso region being the most firm, the head region being of lesser firmness than the upper torso region, the leg region being of considerably lesser firmness than the head region, and the lower torso region being of the firmness of roughly about that of the head region;

and with the several firmnesses being pre-selected to provide a substantially level body support lengthwise upon the mattress.

2. A mattress as defined in claim 1, and with the length of said head region being roughly 18% of the mattress length;

the length of the combined torso region being roughly 37% of the mattress length and with the upper torso region formed of roughly the upper two-thirds of the combined torso region length, with remainder forming the lower torso zone;

and the length of the leg support region being roughly 45% of the mattress.

3. A mattress as defined in claim 1, and with the firmnesses of the lower torso region being the same as that of the head region.

4. A mattress as defined in claim 1, and said mattress being formed of a conventional coil spring construction, and wherein the number of coil springs measured in a row along the mattress length in the head support region is a predetermined number regardless of the length of the mattress, but the number of the springs in the torso support region and in the leg support region vary in number depending upon the overall length of the mattress.

5. A mattress as defined in claim 4, and wherein the springs in each one of the head and leg support regions and the upper and lower torso zones are made with the same springy firmness, but with the springs of each region being of a different firmness than the springs in the next adjacent region.

6. A mattress as defined in claim 5, and wherein the sizes of the springs in each of the regions are the same and the gauge of the spring wire of all of the springs in any one region is the same, but with the gauges varying in the springs in one region relative to the other regions, so that the springs in the upper torso region are of the heaviest, stiffest gauge, whereas the springs in the head support region are of thinner, less stiff gauge than that of the springs in the upper torso support region, and the springs in the leg support region are of an even thinner and less stiff gauge than that of the springs of the head support region, and the springs in the lower torso region are about the same gauge as the springs in the head region.

7. A mattress as defined in claim 6 and including a row of stiff springs, i.e., springs made of stiffer gauge wire than the gauges used for the head and leg regions, arranged around the periphery of the mattress to form a stiffer border around the edges of the mattresses.

* * * * *

UNITED STATES PATENT AND TRADEMARK OFFICE

CERTIFICATE OF CORRECTION

PATENT NO. : 4,679,266

DATED : July 14, 1987

INVENTOR(S) : Eugene Kraft

It is certified that error appears in the above-identified patent and that said Letters Patent is hereby corrected as shown below:

In claim 1, line 4, change "substantial" to --substantially--

In claim 1, line 5, after "four", add --adjacent-- and
in line 6, after "regions", add --sequentially--

Signed and Sealed this

Thirteenth Day of October, 1987

*Attest:*

DONALD J. QUIGG

*Attesting Officer*

*Commissioner of Patents and Trademarks*